US007805104B2

(12) United States Patent
Yamaguchi et al.

(10) Patent No.: US 7,805,104 B2
(45) **Date of Patent: *Sep. 28, 2010**

(54) MAGNETIC ELEMENT-APPLIED MEDIUM, AND MEDIUM INFORMATION READING METHOD AND DEVICE

(75) Inventors: Shoji Yamaguchi, Kanagawa (JP); Yasunori Koda, Kanagawa (JP); Mario Fuse, Kanagawa (JP); Kunihiro Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1084 days.

This patent is subject to a terminal disclaimer.

(21) Appl. No.: 11/286,363

(22) Filed: Nov. 25, 2005

(65) Prior Publication Data

US 2006/0216087 A1 Sep. 28, 2006

(30) Foreign Application Priority Data

Mar. 23, 2005 (JP) ..... 2005-084177

(51) Int. Cl.
*G03G 15/00* (2006.01)

(52) U.S. Cl. ..... 399/366; 324/232; 324/243; 324/263

(58) Field of Classification Search ..... 399/366; 324/232, 243, 263; *G03G 21/04, 21/00*
See application file for complete search history.

(56) References Cited

U.S. PATENT DOCUMENTS

| | | | | |
|---|---|---|---|---|
| 5,821,859 | A * | 10/1998 | Schrott et al. | 340/572.6 |
| 6,501,267 | B1 * | 12/2002 | Kurokawa et al. | 324/242 |
| 6,580,820 | B1 * | 6/2003 | Fan | 382/135 |
| 6,817,536 | B1 * | 11/2004 | Matthewson | 235/493 |
| 7,170,286 | B2 * | 1/2007 | Takahashi et al. | 324/228 |

FOREIGN PATENT DOCUMENTS

| | | |
|---|---|---|
| EP | 1 204 944 B1 | 4/2003 |
| JP | A-04-112281 | 4/1992 |
| JP | A-05-219351 | 8/1993 |
| JP | A-08-212281 | 8/1996 |
| JP | A-2001-159094 | 6/2001 |
| JP | A-2004-199522 | 7/2004 |
| JP | 2004285524 A * | 10/2004 |

* cited by examiner

*Primary Examiner*—Judy Nguyen
*Assistant Examiner*—Andy L Pham
(74) *Attorney, Agent, or Firm*—Oliff & Berridge, PLC

(57) ABSTRACT

An information reading device for reading identification information from a medium to which at least one magnetic element for generating a signal upon receiving a magnetic field is provided, which includes a plurality of detecting parts that detect a signal generated from the magnetic element according to the magnetic field applied to the medium, and an information reading part that reads information formed by the magnetic element based on a combination of detecting parts which have detected the generated signal.

2 Claims, 13 Drawing Sheets

MAGNETIC ELEMENT-APPLIED MEDIUM, AND MEDIUM INFORMATION READING METHOD AND DEVICE

BACKGROUND OF THE INVENTION

1. Field of the Invention

The present invention relates to a medium to which a magnetic element is applied, and a method and device for reading information of the medium, and more particularly to a medium to which applied is a magnetic element from which information formed of the magnetic element applied to the medium is read depending on a combination of detecting circuits having detected the magnetic element applied to the medium among plural detecting circuits for detecting the magnetic element, and a method and device for reading information of the medium.

2. Description of the Background Art

In recent years, there are provided various methods and devices to enhance security such as prevention of leakage of confidential information, personal information and the like, prevention of counterfeiting of valuable securities by unauthorized copying and the like.

In order to prevent counterfeiting of valuable securities and the like, there is proposed, for example, a method of preventing counterfeiting of valuable securities and the like by using special paper having a special pattern or a latent image of a special ink or the like which contains an infrared absorption agent to produce the valuable securities and the like.

This method is configured to prevent counterfeiting by identifying that when valuable securities and the like produced using special paper are copied by a scanner (image reading device), a copy machine or the like, a particular pattern, a special ink or the like formed as a latent image on the special paper is printed in a visible state indicating a reproduction.

For example, there are proposed anti-falsification paper that makes it quite difficult to counterfeit by a color copy machine or the like or to counterfeit paper for securities and securities using the same, and an image processing device and method capable of adding a particular pattern without fail even if a particular original document is attempted to be reproduced.

The proposed anti-falsification paper is configured to inhibit counterfeiting by forming anti-falsification paper which has a paper wafer or a piece of fiber coated with ink containing a metameric coloring material and a paper wafer or a piece of fiber which is colored with an ordinary color ink which is seen having the same color phase under ordinary light such as sunlight as the ink containing the metameric coloring material woven in substantially the same amount into a paper base formed of pulp fiber, so that two types of spots having a different color phase appear on color-copied valuable securities.

The proposed image processing device and method indicates that the image of an original document and the image of a transfer material are compared to judge peculiarity of the original document, and an output image of the original document having the peculiarity is output after fabricating without fail, and it can be used as a key to specify a location of the copied device if a particular original document (e.g., paper money) which normally must not be copied is copied.

But, what are indicated above are configured to detect a particular pattern which is given to paper when image information of paper is copied and printed out or to identify that paper is a copy because it is copied with a particular pattern added. Therefore, it is desired to propose a method and device that disables copying of paper immediately without scanning the paper or judging whether or not paper is a particular original document, and to propose anti-falsification paper or the like.

The method of detecting a particular pattern given to paper optically by scanning the paper may have a possibility that the particular pattern is falsely detected if the area having the particular pattern has dust, dirt or the like. Therefore, it is desired to propose a device and method having high reliability to inhibit copying by surely detecting non-copiable information given to paper without being influenced by the above situation.

SUMMARY OF THE INVENTION

An aspect of the present invention provides an information reading device for reading identification information from a medium to which at least one magnetic element for generating a signal upon receiving a magnetic field is provided, which includes a plurality of detecting parts that detect a signal generated from the magnetic element according to the magnetic field applied to the medium, and an information reading part that reads information formed by the magnetic element based on a combination of detecting parts which have detected the generated signal.

A further aspect of the present invention provides an information reading method, which includes: providing at least one magnetic element to a medium; detecting a signal, which is generated from the magnetic element by a magnetic field applied to the medium by a plurality of detecting parts; and reading information formed by the magnetic element according to a combination of the plurality of detecting parts which have detected the generated signal.

A still further aspect of the present invention provides a medium to which at least one magnetic element which generates a signal upon receiving a magnetic field is provided, in which the magnetic element is disposed at an interval exceeding a detection area of detecting coils which detects the magnetic element, and information for identifying the medium is formed in correspondence with the number of magnetic elements.

BRIEF DESCRIPTION OF THE DRAWINGS

Embodiments of the present invention will be described in detail based on the following figures, wherein.

DETAILED DESCRIPTION OF THE INVENTION

A medium to which a magnetic element is applied, and a medium information reading method and device according to the present invention are applied to, for example, a printing machine, a copy machine and the like for prevention of counterfeiting by wrongfully copying valuable securities and the like, prevention of leakage of information by wrongfully copying paper on which confidential information, personal information and the like are printed, or document management and the like.

Where the present invention is applied to a printing machine, this printing machine is used as a document manageable printing machine by using for paper on which information is printed exclusive paper to which identification information for identifying a paper inherence indicated by a magnetic element is applied, and managing the identification information of the exclusive paper and the information printed on the exclusive paper in correspondence with each other.

Where the present invention is applied to a copy machine, if managed confidential information or the like is attempted to be copied, a magnetic element applied to an original document on which the confidential information or the like is printed is detected, to identify that the original document is a confidential document or an important document, and a copy operation is allowed only when a password with authority to handle the original document is input, thereby enabling to prevent confidential information, important document or the like from being copied without authorization and to prevent information from being leaked or counterfeited.

In the following example, a medium to which identification information indicated in correspondence with a magnetic element is applied and a method and device of reading information of the medium will be described.

An example that a medium to which a magnetic element is applied and a method and device for reading information of the medium according to the present invention are applied to a copy machine will be described in detail with reference to the accompanying figures.

Figure 1A:
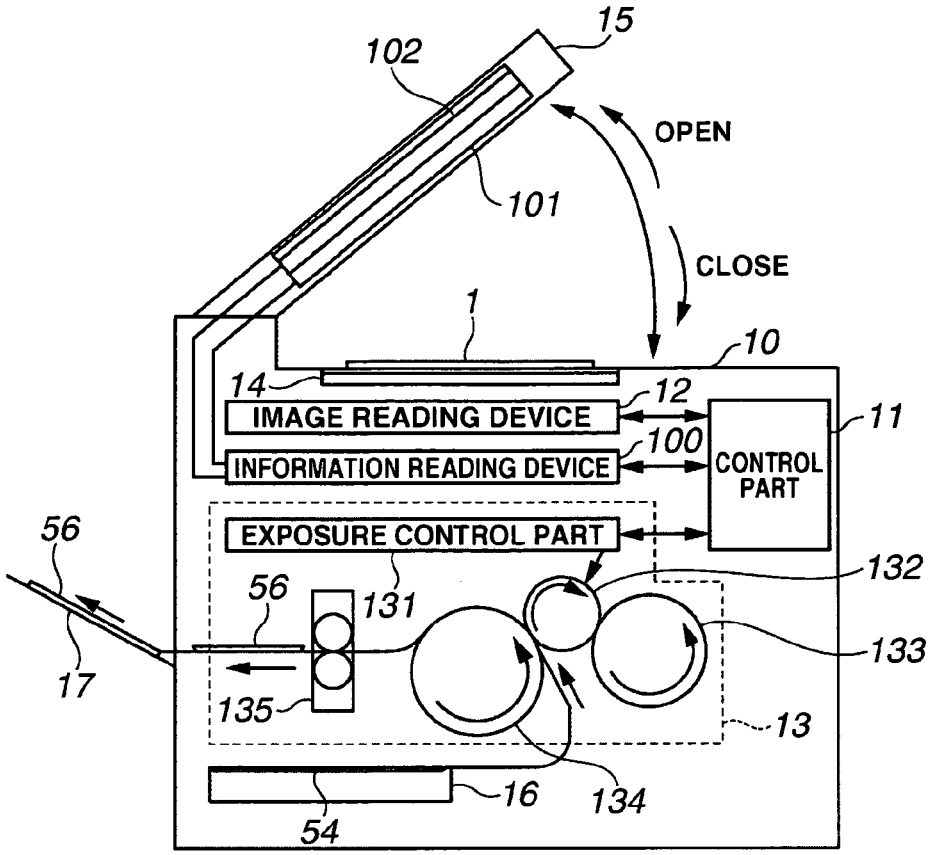
FIGS. 1A and 1B are schematic views of a copy machine 10 provided with an information reading device 100 according to the present invention.
Figure 1B:
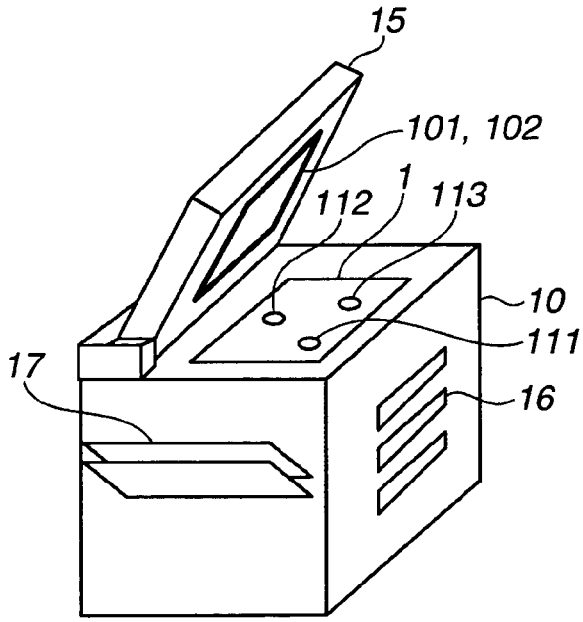

FIG. 1A and FIG. 1B are schematic views showing a copy machine 10 provided with an information reading device 100 according to the present invention. FIG. 1A is a block diagram schematically showing the copy machine 10, and FIG. 1B is a schematic, perspective diagram of the copy machine 10.

As shown in FIGS. 1A and 1B, the copy machine 10 comprises the information reading device 100 which detects magnetic elements 111, 112, 113 applied to an original document 1 placed on a platen glass 14 of the copy machine 10 and detects identification information of the original document 1 based on the detected result; a control part 11 which integrally controls the copy machine 10 as a whole and controls to judge whether or not an input password is a password with authority to allow copying the original document 1 based on identification information of the original document 1 output from the information reading device 100 and the password input by a user, and when a password is input to allow copying the original document 1, performs a copy operation of the original document 1 by the copy machine 10, but when a password is not input to allow copying the original document 1, controls to inhibit copying; an image reading device 12 which emits light to the original document 1 placed on the platen glass 14, receives the reflection of the emitted light from the original document 1 by an unshown photoelectric converting element (e.g., CCD=Charge Coupled Device or the like), converts it into an electrical signal, reads image information of the original document 1 according to the converted electrical signal, and performs a prescribed image processing of the read image information; and an image forming section 13 which prints the image information of the original document 1 read by the image reading device 12 on paper 54 fed from a sheet tray 16 and discharges to an output tray 17.

The image forming section 13 comprises an exposure control part 131 which emits a laser beam to a photoconductive drum 132 according to output image data output after the image processing of the image information read from the original document 1 by the image reading device 12 and controls scanning exposure of the photoconductive drum 132; a developing device 133 which forms a toner image by developing a latent image, which is formed on the surface of the photoconductive drum 132 by the scanning exposure control performed by the exposure control part 131, with individual color toners; a transfer drum 134 which transfers the toner image formed on the photoconductive drum 132 by the developing device 133; and a fixing device 135 which fixes the toner image formed on the transfer drum 134 onto paper 54 fed from the sheet tray 16.

In a platen cover 15 of the copy machine 10, there are disposed plural magnetizing coils 101 and plural detecting coils 102 of the information reading device 100 for detecting the magnetic elements 111, 112, 113 applied to the original document 1 placed on the platen glass 14, the individual magnetizing coils 101 emit prescribed alternating magnetic fields, the individual detecting coils 102 receive the alternating magnetic fields emitted from the individual magnetizing coils 101 and magnetic pulses and electromagnetic waves emitted from the individual magnetic elements, and the information reading device 100 detects and outputs identification information of the original document 1 according to the detected results by the magnetic elements 111, 112, 113 applied to the original document 1.

Password information, which has a password with authority to allow copying of an original document and identification information of the original document mutually associated, is previously stored in the copy machine 10. The password information and the identification information of the original document detected from the original document are compared to determine whether or not the original document 1 placed on the platen glass 14 is a copiable or non-copiable original document.

If the magnetic element is not applied to the original document 1, it is determined as a copiable original document, and a copy operation of the original document 1 is performed by the copy machine 10.

And, the structure of the information reading device 100, and a method of detecting the magnetic elements 111, 112, 113 applied to the original document 1 will be described later.

An operation to copy or to inhibit copying of the original document 1 by the copy machine 10 configured as described above according to the detected result of the identification information of the original document 1 placed on the platen glass 14 will be described briefly.

The original document 1 is placed on the platen glass 14 of the copy machine 10, the platen cover 15 is closed (the arrow direction in the figure), and an unshown copy start button is pressed. Then, the control part 11 of the copy machine 10 activates the information reading device 100 before the copy operation to copy the original document 1.

When the information reading device 100 operates, prescribed alternating magnetic fields are emitted from the individual magnetizing coils 101, the individual magnetic elements 111, 112, 113 applied to the original document 1 on the platen glass 14 are magnetized upon receiving the alternating magnetic fields, precipitous magnetic pulse is emitted at the time of magnetization reversal, or the individual magnetic elements vibrate magnetostrictively, and electromagnetic waves are emitted from the individual magnetic elements by the magnetostrictive vibration.

The magnetic pulses or electromagnetic waves emitted from the individual magnetic elements are received by the detecting coils 102 which are positioned where the individual magnetic elements applied to the original document 1 are arranged and positioned closest to them depending on the direction of the original document 1 placed on the platen glass 14, and the information reading device 100 detects identification information of the original document 1 according to the disposed positions of the detecting coils 102, which have received the magnetic pulses or electromagnetic waves emitted from the individual magnetic elements, among the plural detecting coils 102.

When the information reading device 100 detects the identification information of the original document 1, an audio message such as "Please input a password." or the like or such an indication is issued or shown to urge the user to input a password. According to the input password and the identification information of the original document 1 output from the information reading device 100, it is controlled to perform a copy operation or a copy inhibition operation of the original document 1.

Specifically, the password information is referred to for the input password and the identification information of the original document 1, and it is controlled to perform the copy operation when a password registered in password information corresponding to the identification information of the original document 1 matches the input password.

If the registered password and the input password do not match, a message indicating copy inhibition such as "This original document is non-copiable." or a warning beep is output, and it is controlled to perform a non-copiable operation at the same time.

If the information reading device 100 could not detect the signal emitted from the original document 1 by the magnetic element, the original document 1 is recognized as a copiable original document, and it is controlled to perform a copy operation.

When the copy operation of the copy machine 10 is controlled, the image information of the original document 1 placed on the platen glass 14 of the copy machine 10 is read by the image reading device 12, the read image information is printed by the image forming section 13 on the paper 54 fed from the sheet tray 16, and the printed paper 54 is discharged to the output tray 17.

The detection of the identification information of the original document 1 by the information reading device 100 may be performed after the original document 1 is placed on the platen glass 14 of the copy machine 10, after a copy start instruction is given to the copy machine 10 or before the copy start instruction is given and is not particularly limited when it is performed.

The type, quantity and shape of magnetic elements applied to the original document 1 are not particularly limited, and the magnetic element may be one or plural types of plural magnetic elements may be applied depending on the identification information of the original document 1 applied to identify the original document 1.

It is advisable that the magnetic elements applied to the original document 1 are disposed at intervals exceeding the detection area based on the arranged intervals of the detecting coils for detecting the magnetic elements.

Figure 2:
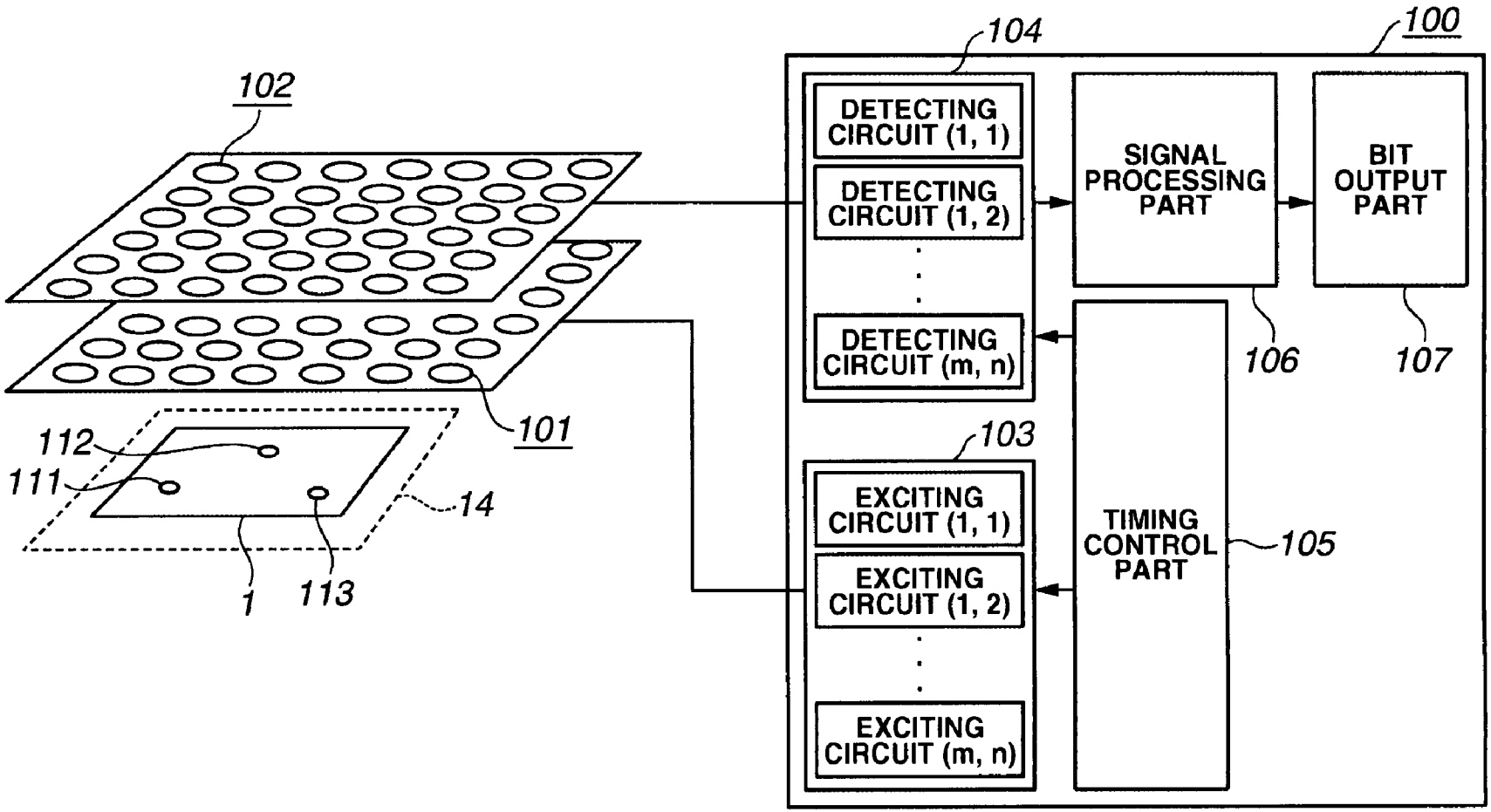
FIG. 2 is a block diagram showing a structure of a main portion of the information reading device 100.

FIG. 2 is a block diagram showing a structure of a main part of the information reading device 100 according to the present invention.

The information reading device 100 shown in FIG. 2 is an information reading device applied when the individual magnetic elements applied to the original document 1 are magnetic elements which have a characteristic, the so-called large Barkhausen effect, that a precipitous magnetic pulse is emitted at the time of the magnetization reversal when the individual magnetic elements receive a prescribed magnetic field.

In FIG. 2, the plural magnetizing coils 101 and the plural detecting coils 102 of the information reading device 100 are disposed in the platen cover 15 of the copy machine 10, wherein individual pairs are formed of one magnetizing coil 101 and one detecting coil 102.

FIG. 2 is a block diagram showing a structure of a main part of the information reading device 100 according to the present invention.

The information reading device 100 shown in FIG. 2 is an information reading device applied when the individual magnetic elements applied to the original document 1 are magnetic elements which have a characteristic, the so-called large Barkhausen effect, that a precipitous magnetic pulse is emitted at the time of the magnetization reversal when the individual magnetic elements applied to the original document 1 are magnetized upon receiving a prescribed magnetic field.

In FIG. 2, the plural magnetizing coils 101 and the plural detecting coils 102 of the information reading device 100 are disposed in the platen cover 15 of the copy machine 10, wherein individual pairs are formed of one magnetizing coil 101 and one detecting coil 102.

As shown in FIG. 2, the information reading device 100 is provided with the plural magnetizing coils (i, j) 101 and the plural detecting coils (i, j) 102 with their arranged positions specified by i=1, 2, . . . , m and j=12 . . . n, plural magnetizing circuits (i, j) 103 connected to the individual magnetizing coils (i, j) 101 respectively, plural detecting circuits (i, j) 104 connected to the individual detecting coils (i, j) 102 respectively, a timing control part 105, a signal processing part 106, and a bit output part 107.

The individual magnetizing circuits (i, j) 103 control to generate a prescribed alternating magnetic field via the magnetizing coils (i, j) 101 connected to the individual magnetizing circuits (i, j) 103 respectively.

The individual detecting circuits (i, j) 104 detect the detection signals of the precipitous magnetic pulses emitted at the time of the magnetization reversal when the magnetic elements 111, 112, 113 applied to the original document 1 are magnetized when a prescribed magnetic field is applied to them according to the signals received by the detecting coils (i, j) 102 connected to the individual detecting circuits (i, j) 104.

The signal processing part 106 detects the magnetic elements 111, 112, 113 applied to the original document 1 according to a combination of the detecting circuits (i, j) 104 having output detection signals corresponding to the magnetic pulses emitted by the individual magnetic elements among the plural detecting circuits (i, j) 104.

The bit output part 107 detects identification information of the original document 1 according to the detected results of the magnetic elements 111, 112, 113 applied to the original document 1 output from the signal processing part 106 and outputs the detected result.

The timing control part 105 controls the timing of the individual magnetizing circuits (i, j) 103 and the individual detecting circuits (i, j) 104 so that the detecting circuits 104 can detect the alternating magnetic fields and the magnetic pulses emitted by the individual magnetic elements in timing corresponding to the cycle of the alternating magnetic fields.

The characteristics of the magnetic elements detected by the information reading device 100 configured as described above and the detecting method thereof will be described with reference to FIGS. 3A and 3B through FIG. 8.

Figure 3A:
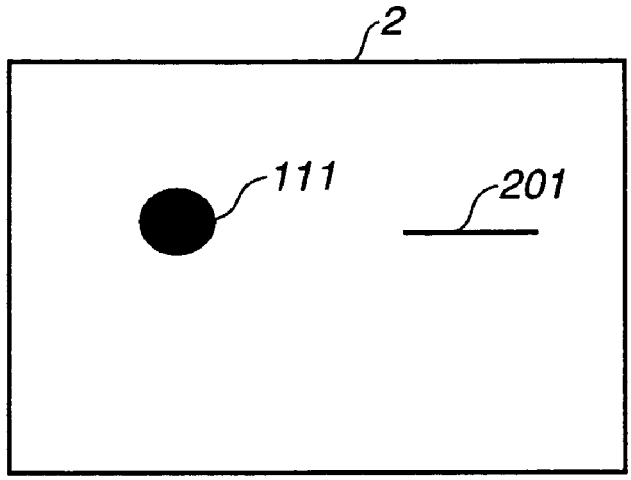
FIGS. 3A and 3B are diagrams showing magnetic characteristics of magnetic elements 111, 201 applied to an original document 2.
Figure 3B:
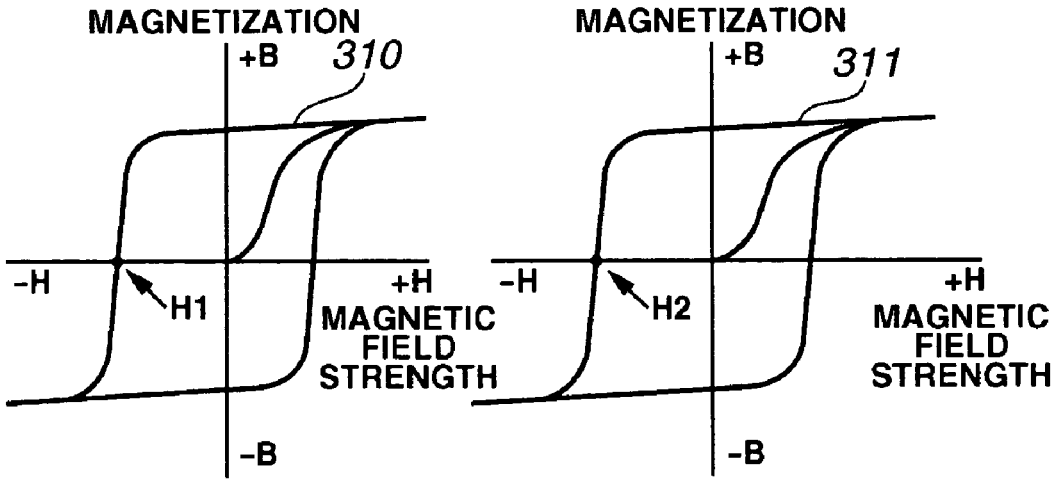

FIG. 3A is a diagram showing the magnetic element 111 and the magnetic element 201 which are applied to the original document 2 and have a difference in size and shape from each other, and FIG. 3B are diagrams showing the individual magnetic characteristics of the magnetic elements 111, 201.

Figure 4A:
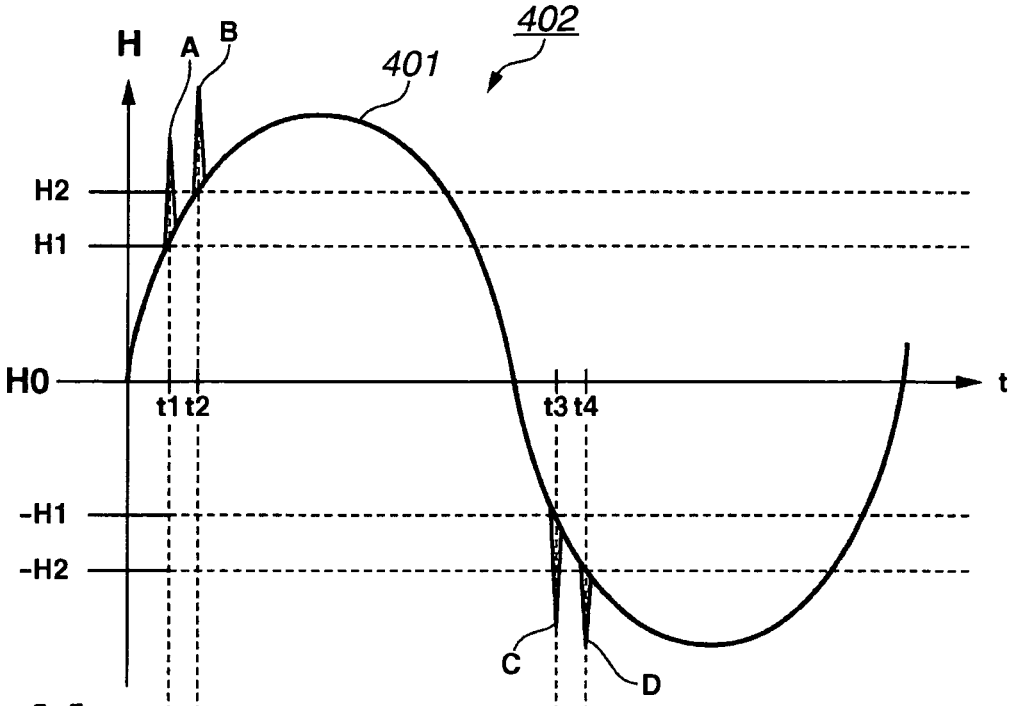
FIGS. 4A and 4B are diagrams showing an example of detection signals of the magnetic elements 111, 201 detected by a detecting circuit.
Figure 4B:
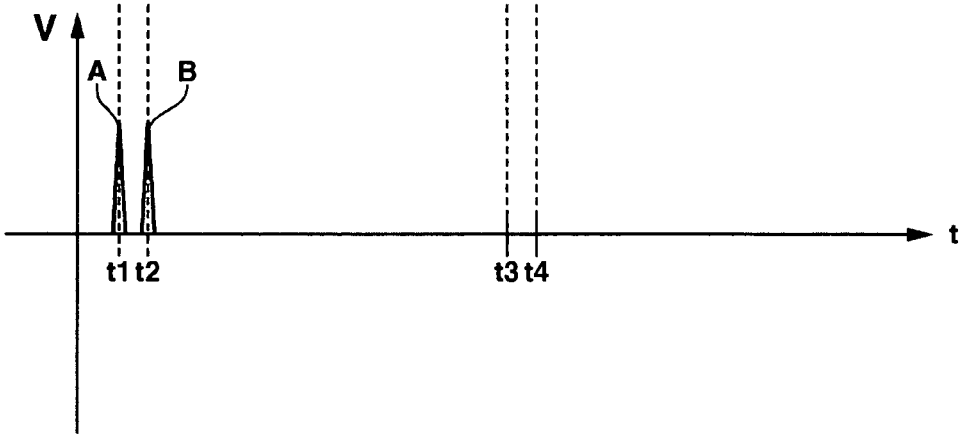

FIG. 4A is a diagram showing detected signals of an alternating magnetic field detected from the original document 2 by the individual detecting circuits (i, j) 104 and the magnetic pulses emitted by the magnetic elements 111, 201 when the magnetic elements 111, 201 of the original document 2 are disposed immediately below the individual detecting circuits (i, j) 104. FIG. 4B is a diagram showing detection pulse signals output from the individual detecting circuits (i, j) 104 after signal processing according to the detected signals shown in FIG. 4A.

The magnetic elements applied to the original document may be a combination of plural types of plural magnetic elements, but FIG. 3A shows an example that the circular magnetic element 111 and the linear magnetic element 201 are applied for convenience of explanation.

As shown in FIGS. 3A and 3B, the magnetic elements 111, 201 applied to the original document 2 are formed of, for example, a magnetic material wire of an Fe—Co based amorphous material. The magnetic element 111 is formed by fabricating the magnetic material wire into a circular shape, and the magnetic element 201 is formed by fabricating the magnetic material wire into a linear shape.

As shown in FIG. 3B, the magnetic elements 111, 201 applied to the original document 2 have magnetic characteristics as indicated by magnetic history curves 310, 311. The magnetic element 111 has, for example, coercive force H1 as indicated by the magnetic history curve 310, and the magnetic element 201 has, for example, coercive force H2 as indicated by the magnetic history curve 311.

The magnetic element 111 having the coercive force H1 performs magnetization reversal upon receiving an alternating magnetic field having a magnetic field strength exceeding H1 and emits a precipitous magnetic pulse at that time, and the magnetic element 201 having the coercive force H2 performs magnetization reversal upon receiving an alternating magnetic field having a magnetic field strength exceeding H2 and emits a precipitous magnetic pulse at that time.

The intrinsic coercive forces H1, H2 possessed by the individual magnetic elements 111, 201 are variable depending on the size, shape and the like of the individual magnetic elements. For example, as indicated by a detection signal 402 of FIG. 4A, the magnetic element 111 having the coercive force H1 performs magnetization reversal upon receiving an alternating magnetic field which has a magnetic field strength of approximately H1 at time t1 from a reference signal output from the timing control part 105 and emits precipitous magnetic pulse A at that time, and also performs magnetization reversal upon receiving an alternating magnetic field having a magnetic field strength of approximately −H1 at time t3 and emits precipitous magnetic pulse C at that time.

The magnetic element 201 having the coercive force H2 performs magnetization reversal upon receiving an alternating magnetic field having a magnetic field strength of approximately H2 at time t2 and emits precipitous magnetic pulse B at that time, and also performs magnetization reversal upon receiving an alternating magnetic field having a magnetic field strength of approximately −H2 at time t4 and emits precipitous magnetic pulse D at that time.

The individual detecting circuits (i, j) 104 of the information reading device 100 detect a detection signal 401 corresponding to an alternating magnetic field emitted from the individual detecting circuits (i, j) 104 shown in FIG. 4A via the receiving coils (i, j) 102 connected to the individual detecting circuits (i, j) 104 and also detect a detection signal 402 containing magnetic pulses A, B, C, D emitted when the individual magnetic elements 111, 201 perform magnetization reversal.

The detection signal 401 which is an alternating magnetic field component is removed from the detection signal 402 detected via the receiving coils (i, j) 102, the pulse signals A, B which are positive signal components are detected from the pulse signals A, B, C, D and amplified to remove noise components, and the detection pulse signals A, B shown in FIG. 4B are detected.

If the individual magnetic elements of the original document 2 are not positioned immediately below the individual detecting circuits (i, j) 104, a detection pulse signal is not output from the individual detecting circuits (i, j) 104.

The detection pulse signals A, B detected by the individual detecting circuits (i, j) 104 are output to the signal processing part 106, and the signal processing part 106 detects the magnetic elements 111, 201 applied to the original document 2 according to the output signals of the detection pulse signals A, B output from the individual detecting circuits (i, j) 104.

Specifically, the number and types of the magnetic elements applied to the original document 2 are detected according to a combination of the detecting circuits (i, j) 104 having output the detection pulse signals among the plural detecting circuits (i, j) 104.

The signal processing part 106 outputs the detected result of the magnetic elements 111, 201 applied to the original document 2 to the bit output part 107, and the bit output part 107 outputs identification information corresponded with the magnetic elements 111, 201 as multi-bit information converted into a value "0" or "1".

Details of correspondence between the magnetic elements applied to the original document and their identification information will be described later.

FIGS. 5A, 5B and FIGS. 6A, 6B are diagrams showing a structure of a main part of the plural magnetizing coils (i, j) 101 and detecting coils (i, j) 102 of the information reading device 100 according to the present invention and a structure of a main part of a medium to which the magnetic elements are applied.

Figure 5A:
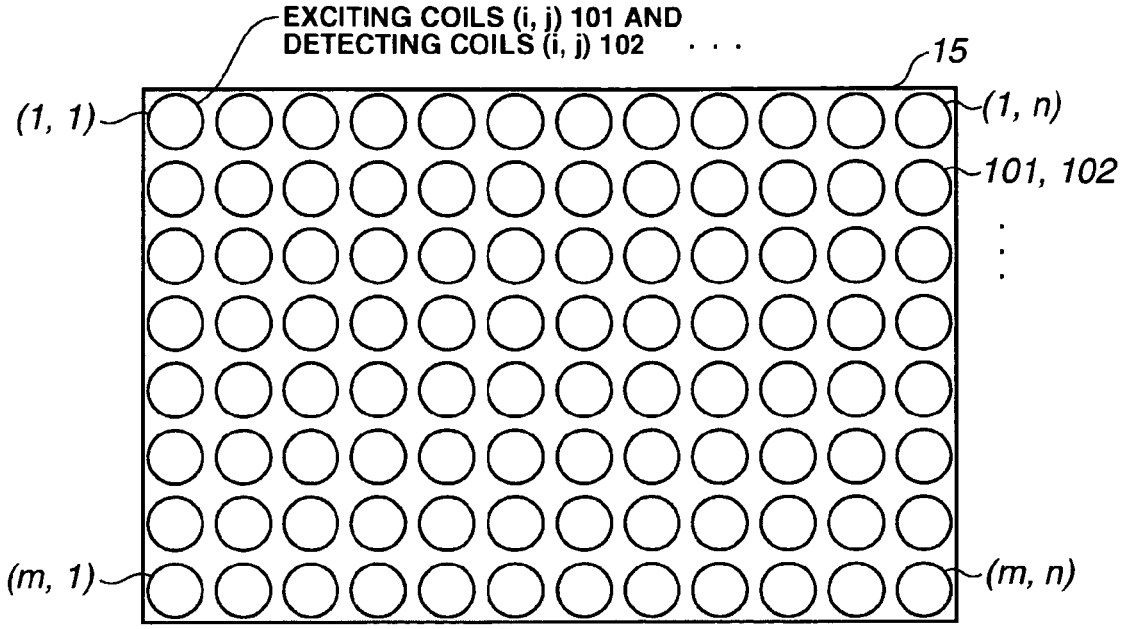
FIGS. 5A and 5B are diagrams showing a structure of a main portion of magnetizing coils 101 and detecting coils 102.
Figure 5B:
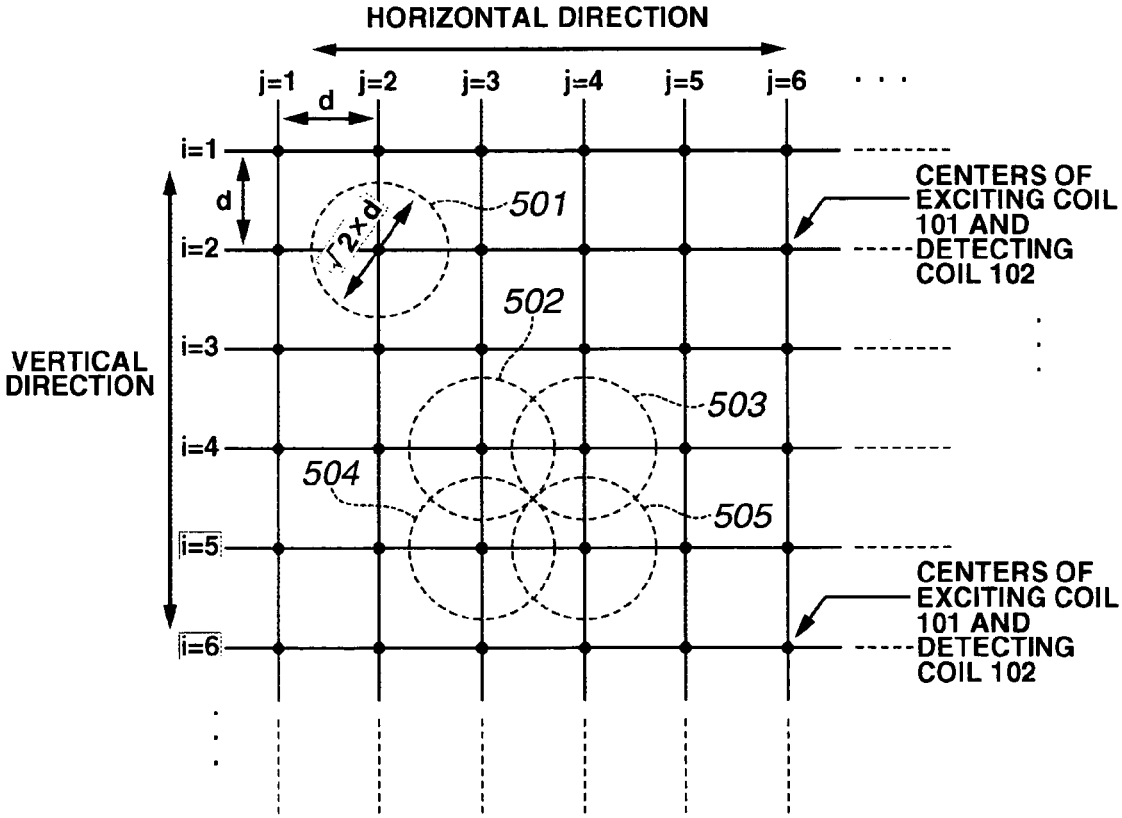

FIG. 5A is a diagram showing an arrangement of the plural magnetizing coils (i, j) 101 and detecting coils (i, j) 102 in the platen cover 15, and FIG. 5B is a diagram showing in detail the arranged positions of the plural magnetizing coils (i, j) 101 and detecting coils (i, j) 102.

Figure 6A:
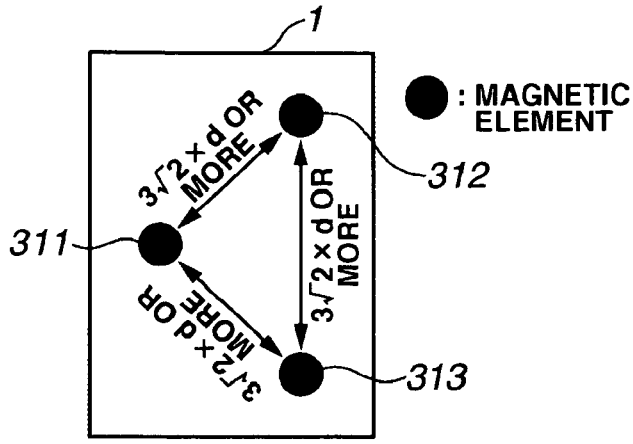
FIGS. 6A and 6B are diagrams showing an example of a medium to which magnetic elements of the present invention are applied.
Figure 6B:
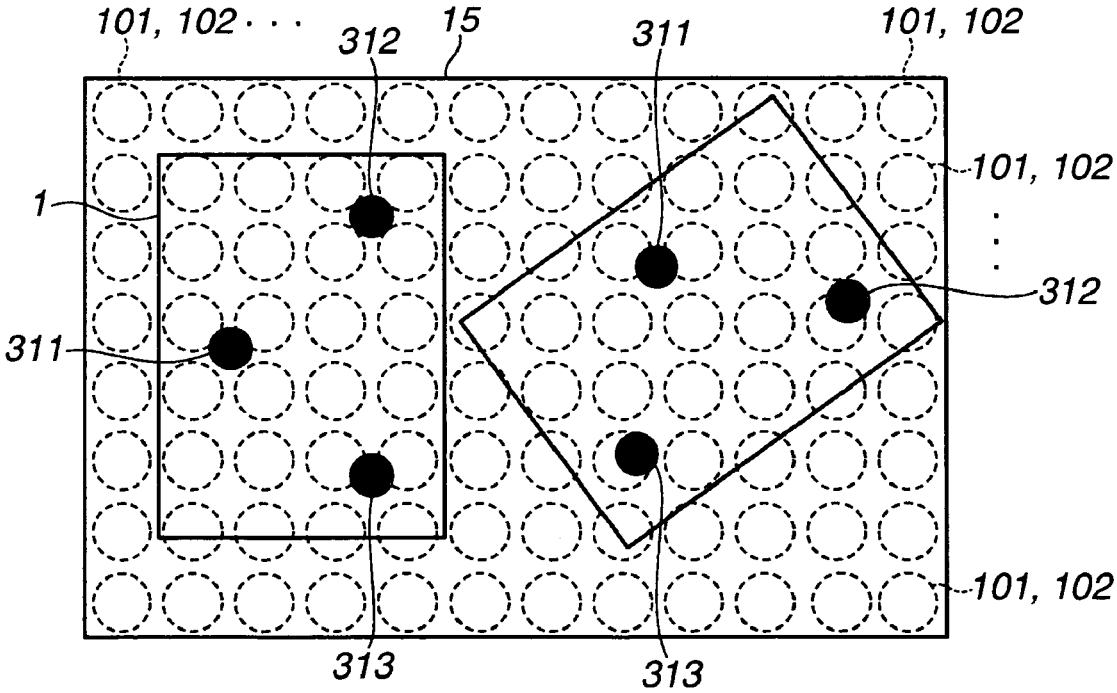

FIG. 6A is a diagram showing an example of the original document 1 which is a medium to which the magnetic element is applied according to the present invention, and FIG. 6B is a diagram showing positional relationships of the original documents 11 and the magnetizing coils (i, j) 101 and detecting coils (i, j) 102 when the original documents 1 are placed on the platen glass 14 of the copy machine 10 and the platen cover 15 is closed.

As shown in FIG. 5A, the plural magnetizing coils (i, j) 101 and detecting coils (i, j) 102 having the same circular size and detection area are regularly arranged in a lattice-like pattern at equal intervals in the platen cover 15.

Specifically, as shown in FIG. 5B, the plural magnetizing coils (i, j) 101 and the plural detecting coils (i, j) 102 form pairs of each of them, and are arranged in a lattice-like pattern at equal intervals in a total of m×n consisting of a number n indicated by j=1, 2, 3, 4, 5, 6, . . . n in the horizontal direction and a number m indicated by i=1, 2, 3, 4, 5, 6, . . . m in the vertical direction.

For the arrangement of the individual magnetizing coils (i, j) 101 and detecting coils (i, j) 102, it is determined for convenience of explanation that the direction in that a value j of the individual magnetizing coils (i, j) 101 and detecting coils (i, j) 102 changes is a horizontal direction and the direction in that a value i of them changes is a vertical direction.

The individual magnetizing coils (i, j) 101 and detecting coils (i, j) 102 are disposed such that the centers of the individual magnetizing coils (i, j) 101 and detecting coils (i, j) 102 are separated from the centers of the their neighboring individual magnetizing coils (i, j) 101 and detecting coils (i, j) 102 by a distance d in the vertical and horizontal directions, and the detection area of a signal emitted from the magnetic elements by the individual magnetizing coils (i, j) 101 and detecting coils (i, j) 102 is a circular area formed to have a diameter of $\sqrt{2}\times d$ from the center of each of the individual magnetizing coils (i, j) 101 and detecting coils (i, j) 102.

For example, when the centers of the magnetizing coil (i, j) 101 and detecting coil (i, j) 102 are determined at (2, 2), the detection area of the magnetizing coil (2, 2) 101 and detecting coil (2, 2) 102 is a circle 501 which is formed to have a diameter of $\sqrt{2}\times d$ with its center at (2, 2).

Similarly, when the centers of the magnetizing coil (i, j) 101 and detecting coil (i, j) 102 are determined at (4, 3), the detection area of the magnetizing coil (i, j) 101 and detecting coil (i, j) 102 is a circle 502 which is formed to have a diameter of $\sqrt{2}\times d$ with its center at (4, 3); when the centers of the magnetizing coil (i, j) 101 and detecting coil (i, j) 102 are determined at (4, 4), the detection area of the magnetizing coil (i, j) 101 and detecting coil (i, j) 102 is a circle 503 which is formed to have a diameter of $\sqrt{2}\times d$ with its center at (4, 4); when the centers of the magnetizing coil (i, j) 101 and detecting coil (i, j) 102 are disposed at (5, 3), the detection area of the magnetizing coil (i, j) 101 and detecting coil (i, j) 102 is a circle 504 which is formed to have a diameter of $\sqrt{2}\times d$ with its center at (5, 3); and when the centers of the magnetizing coil (i, j) 101 and detecting coil (i, j) 102 are disposed at (5, 4), the detection area of the magnetizing coil (i, j) 101 and detecting coil (i, j) 102 is a circle 505 which is formed to have a diameter of $\sqrt{2}\times d$ with its center at (5, 4).

To the original document 1, which is a medium to which the magnetic elements of the present invention are applied, are applied the magnetic elements 111, 112, 113 which are separated from one another by a distance exceeding a prescribed distance as shown in FIG. 6A.

Specifically, the individual magnetic elements 111, 112, 113 are applied to the original document 1 such that the plural magnetizing coils (i, j) 101 and detecting coils (i, j) 102 in the platen cover 15 are separated from one another by a distance exceeding $3\sqrt{2}$ times of the distance d separated at equal intervals, namely a distance exceeding a length of $3\sqrt{2}\times d$.

When the plural magnetizing coils (i, j) 101 and detecting coils (i, j) 102 configured as described above and the original document 1 are used, the original document 1 is placed on the platen glass 14 of the copy machine 10 depending on the direction of the original document 1 placed on the platen glass 14, then the original document 1 and the magnetizing coils (i, j) 101 and detecting coils (i, j) 102 have the positional relationships as shown in FIG. 6B when the platen cover 15 is closed.

Figure 7A:
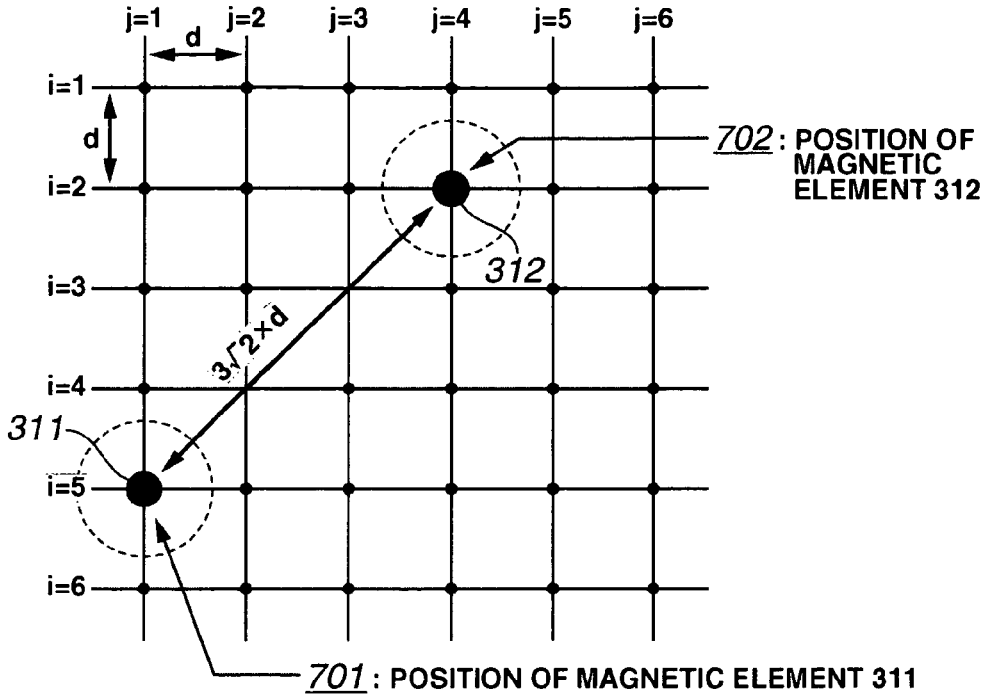
FIGS. 7A and 7B are diagrams showing examples of disposed relationships of a detecting circuit for detecting magnetic elements, plural magnetic elements applied to an original document, and the plural magnetizing coils 101 and detecting coils 102.
Figure 7B:
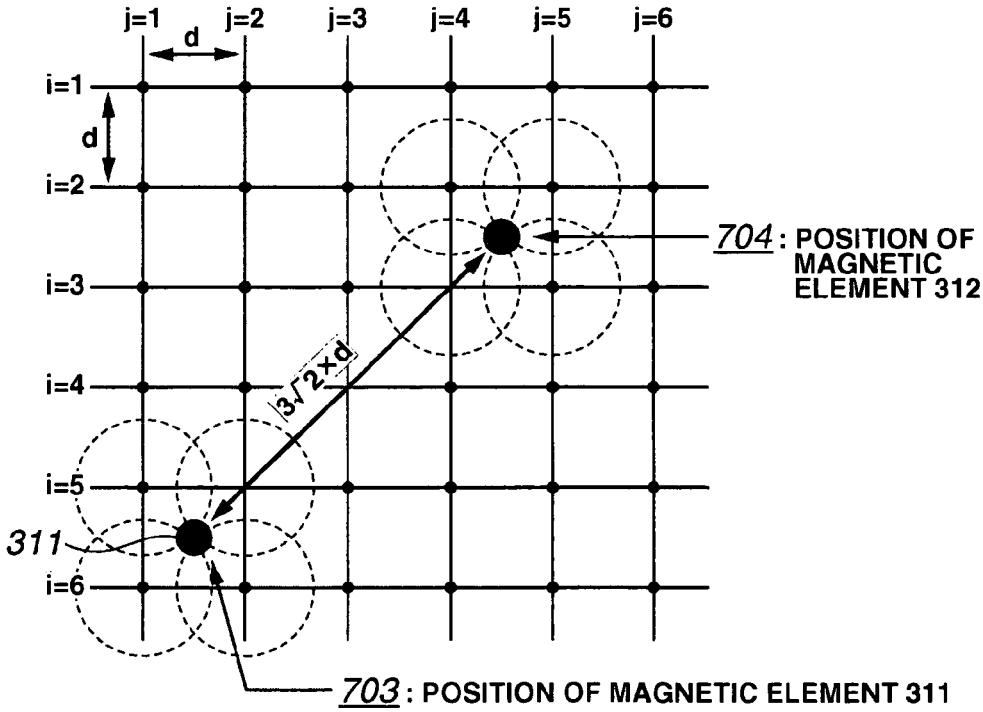

FIGS. 7A and 7B are diagrams showing correspondence between the individual magnetic elements applied to the original document 1 and the magnetizing coils (i, j) 101 and detecting coils (i, j) 102 which detect signals emitted by the individual magnetic elements according to the positional relationships between the individual magnetic elements and the magnetizing coils (i, j) 101 and detecting coils (i, j) 102.

As shown in FIG. 7A, depending on the direction of the original document 1 placed on the platen glass 14, the magnetic element 311 of the original document 1 is disposed at a position 701 of the center position (5, 1) of the magnetizing coil (i, j) 101 and the detecting coil (i, j) 102, and the magnetic element 312 is disposed at a position 702 of the center position (2, 4) of the magnetizing coil (i, j) 101 and the detecting coil (i, j) 102.

By disposing as described above, a signal emitted by the magnetic element 311 of the original document 1 when it receives a prescribed alternating magnetic field is detected by the magnetizing coil (5, 1) 101 and the detecting coil (5, 1) 102 which are disposed at the position 701 of the center position (5, 1) of the coil, and a signal emitted by the magnetic element 312 is detected by the magnetizing coil (2, 4) 101 and detecting coil (2, 4) 102 which are disposed at the position 702 of the center position (2, 4) of the coil.

As shown in FIG. 7B, depending on the direction of the original document 1 placed on the platen glass 14, the magnetic element 311 of the original document 1 is disposed at a position 703 which is at an equal distance from the center positions (5, 1), (5, 2), (6, 1), (6, 2) of the magnetizing coils (i, j) 101 and the detecting coils (i, j) 102 respectively, and the magnetic element 312 is disposed at a position 704 which is at an equal distance from the center positions (2, 4), (2, 5), (3, 4), (3, 5) of the magnetizing coils (i, j) 101 and the detecting coils (i, j) 102 respectively.

When configured as described above, the magnetic element 311 is present in the detection areas formed by four pairs of the magnetizing coil (5, 1) 101 and detecting coil (5, 1) 102, the magnetizing coil (5, 2) 101 and detecting coil (5, 2) 102, the magnetizing coil (6, 1) 101 and detecting coil (6, 1) 102 and the magnetizing coil (6, 2) 101 and detecting coil (6, 2) 102 corresponding to the center positions (5, 1), (5, 2), (6, 1), (6, 2) of the individual coils. Thus, the signal emitted by the magnetic element 311 when it is given a prescribed alternating magnetic field is detected by the four magnetizing coils (i, j) 101 and the four detecting coils (i, j) 102.

And, the magnetic element 312 is present in the detection areas formed by four pairs of the magnetizing coil (2, 4) 101 and detecting coil (2, 4) 102, the magnetizing coil (2, 5) 101 and detecting coil (2, 5) 102, the magnetizing coil (3, 4) 101 and detecting coil (3, 4) 102 and the magnetizing coil (3, 5) 101 and detecting coil (3, 5) 102 corresponding to the center positions (2, 4), (2, 5), (3, 4), (3, 5) of the individual coils. Thus, the signal emitted by the magnetic element 312 when it is given a prescribed alternating magnetic field is detected by the four magnetizing coils (i, j) 101 and the four detecting coils (i, j) 102.

Thus, the signal processing part 106 of the information reading device 100 detects the individual magnetic elements applied to the original document 1 according to a combination of the detecting circuits (i, j) 104 which detect and output the detection pulse signal among the plural detecting circuits (i, j) 104.

Figure 8:
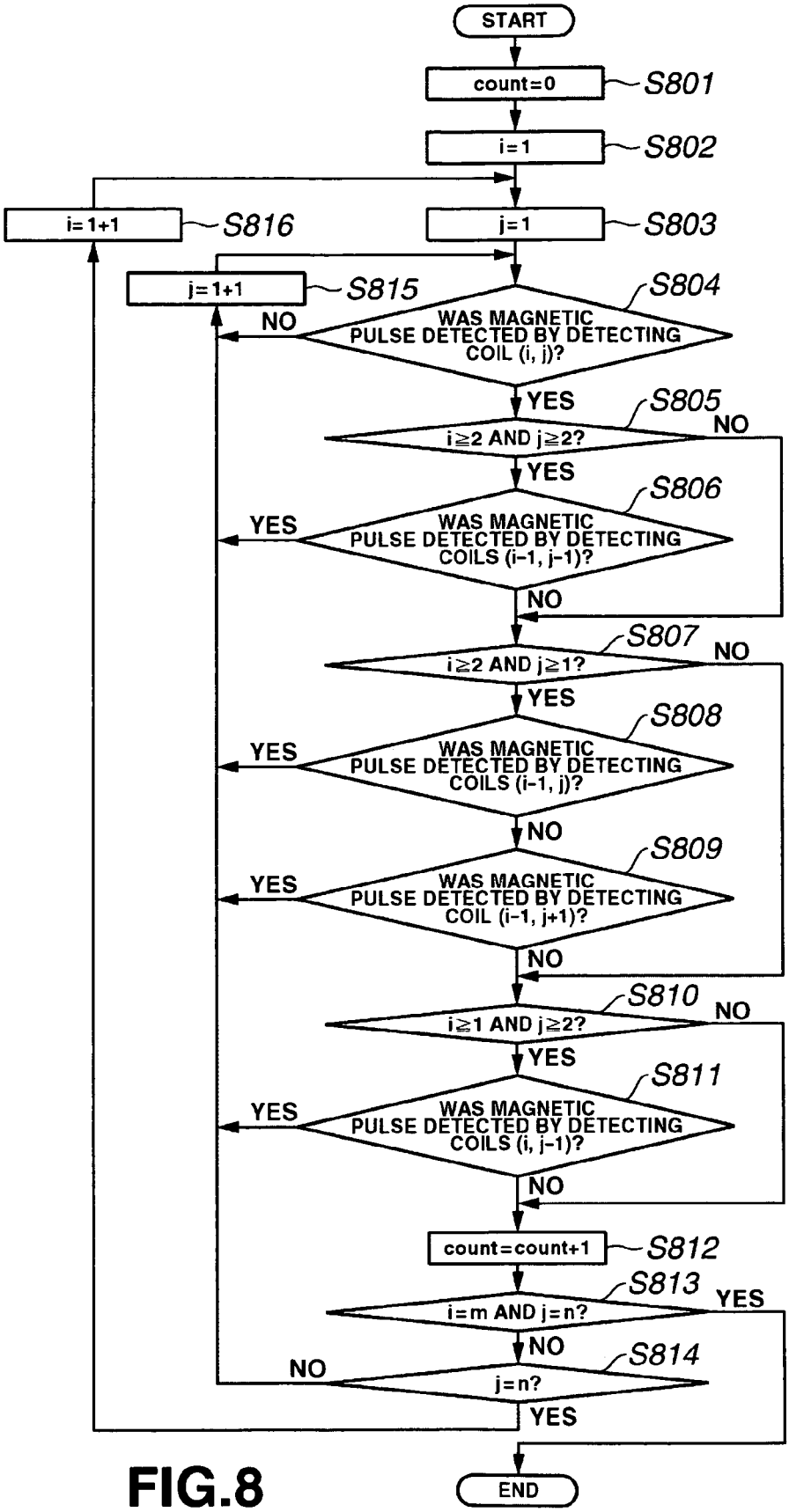
FIG. 8 is a diagram showing an example of a method to detect the number of magnetic elements applied to an original document according to a combination of detecting circuits having detected the magnetic elements by the signal processing portion 10.

FIG. 8 is a flow chart showing an example of a method for detecting the individual magnetic elements applied to the original document 1 by the signal processing part 106 according to the detection pulse signal output from the individual detecting circuits (i, j) 104.

As shown in FIG. 8, the signal processing part 106 checks the detected results of the detection pulse signal obtained by the individual detecting circuits (i, j) 104 in order of i=1, 2, . . . , n and j=1, 2, . . . , m of the detecting circuit (i, j) 104, and if there is a detecting circuit (i, j) 104 by which the detection pulse signal is detected, even if a detection pulse signal is detected by the individual detecting circuits (i, j) 101 which are connected to the individual detecting coils (i, j) 101 which are disposed at the upper left adjacent position, the upper adjacent position, the upper right adjacent position, the left adjacent position, the right adjacent position, the lower left adjacent position and the lower right adjacent position of the detecting coil (i, j) 101 connected to the pertinent detecting circuit (i, j) 104 other than the pertinent detecting circuit (i, j) 104, it is detected as a detection signal emitted by the same magnetic element.

Specifically, after the values of a counter (=COUNT) indicating the number of the magnetic elements applied to the original document 1 and pointers i and j designating the detecting circuit (i, j) are initialized (COUNT=0, i=0, j=0) (steps S801 through S803), the presence or not of detection of the detection pulse signal by the individual detecting circuits (i, j) 104 is checked for each of the individual detecting circuits (i, j) 104 designated in order of the pointers i=1, 2, . . . , n and j=1, 2, . . . , m (step S804).

If there is a detecting circuit (i, j) 104 which has detected the detection pulse signal in step S804 (YES in step S804), a counter (=COUNT), which counts the number of the magnetic elements if the detection pulse signal is not detected by a detecting circuit (i−1, j−1) 104, a detecting circuit (i−1, j) 104, a detecting circuit (i−1, j+1) 104 and a detecting circuit (i, j−1) 104 which are connected to the individual detecting coils (i, j) 101 which are disposed at the upper left, upper, upper right and left adjacent positions of the detecting coil (i, j) 101 connected to the detecting circuit (i, j) 104, counts up (steps S805 through S812).

Then, it is checked whether or not the detection pulse signal is detected by the detecting coil (i, j+1) 101 which is disposed at the right adjacent position of the detecting coil (i, j) 101 connected to the detecting circuit (i, j) 104 having detected the detection pulse signal, and the same operation is repeated up to the detecting circuits (m, n) 104 to check (step S803 through S816), so that the number of the magnetic elements applied to the original document can be detected.

The bit output part 107 detects identification information corresponding to the number of magnetic elements applied to the original document which is output from the signal processing part 106 and outputs the detected results.

An example of the method for detecting identification information corresponding to the number of magnetic elements by the bit output part 107 will be described with reference to FIGS. 9A through 9D.

FIGS. 9A through 9D are diagrams showing examples of original documents to which identification information formed by a combination of magnetic elements 311, 312, 313 is applied.

Figure 9A:
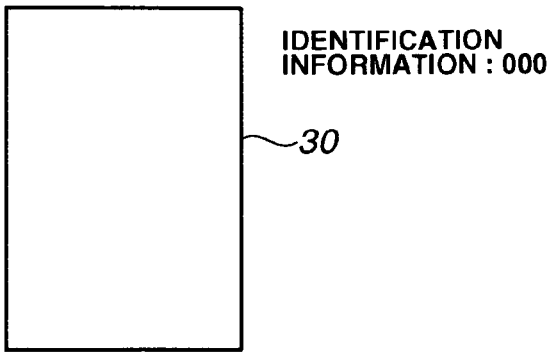
FIGS. 9A through 9D are diagrams showing examples of identification information to be detected by a bit output portion 107 in accordance with the number of magnetic elements applied to the original document.
Figure 9B:
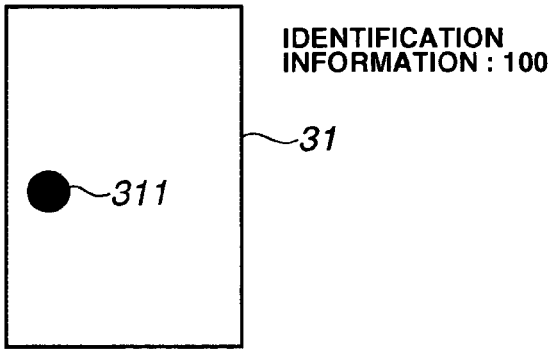
Figure 9C:
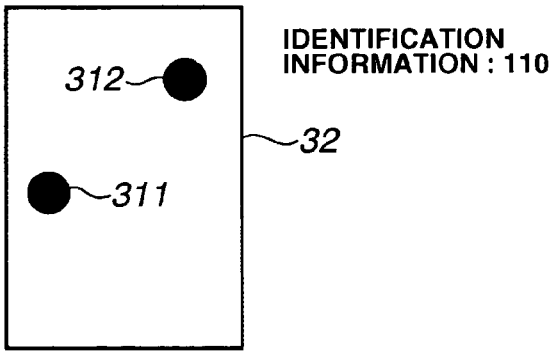
Figure 9D:
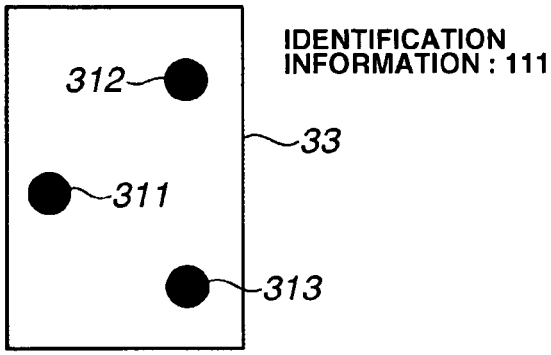

FIG. 9A is a diagram showing an original document 30 to which a magnetic element is not applied, FIG. 9B is a diagram showing an original document 31 to which a single magnetic element is applied, FIG. 9C is a diagram showing an original document 32 to which two magnetic elements are applied, and FIG. 9D is a diagram showing an original document 33 to which three magnetic elements are applied.

Where identification information corresponding to the number of magnetic elements is detected by the bit output part 107, it is detected as identification information of a bit number corresponding to, for example, the number of the magnetic elements applied to the original document.

Specifically, where three magnetic elements are combined to express the identification information and applied to the original document, the identification information is detected as 3-bit information in correspondence with the number of the three magnetic elements, where no magnetic element is applied like the original document 30 as shown in FIG. 9A, it is detected as identification information "000", where one magnetic element is applied like the original document 31 as shown in FIG. 9B, it is detected as identification information "100", where two magnetic elements are applied like the original document 32 as shown in FIG. 9C, it is detected as identification information "110", and where three magnetic elements are applied like the original document 33 as shown in FIG. 9D, it is detected as identification information "111".

Thus, the bit output part 107 outputs as multi-bit information the identification information of the original document according to the detected results of the number of the magnetic elements applied to the original document according to a combination of the detecting circuits (i, j) 104, which have output the detection signal corresponding to the magnetic pulses emitted by the individual magnetic elements, among the plural detecting circuits (i, j) 104.

Figure 10:
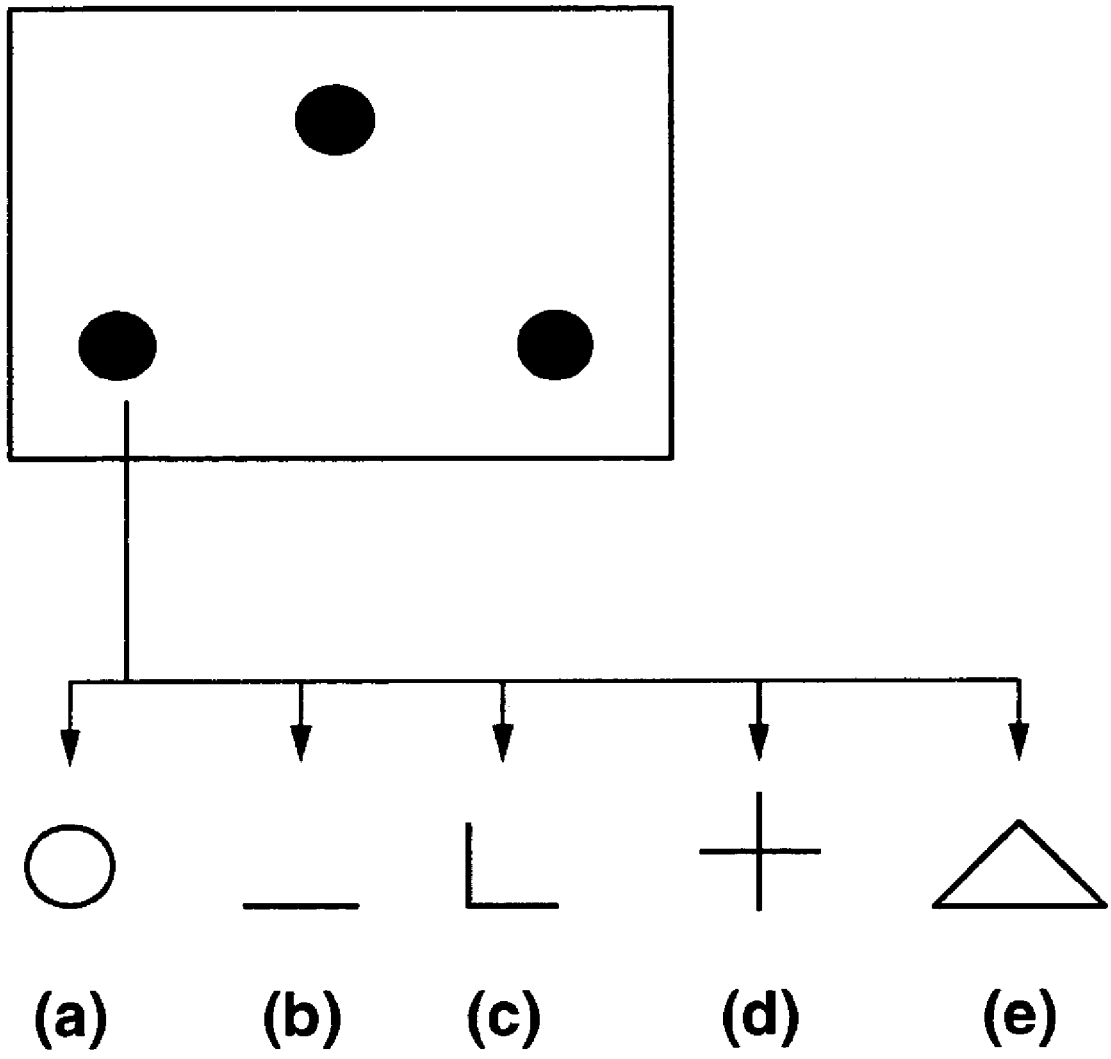
FIG. 10 is a diagram showing examples of shapes of magnetic elements applied to an original document according to the present invention.

As shown in FIG. 10, the magnetic element applied to the medium according to the present invention may be various shapes of magnetic elements such as a circular type ((a) of FIG. 10), a linear type ((b) of FIG. 10), an L-shaped type ((c) of FIG. 10), a cross type ((d) of FIG. 10) and a triangle type ((e) of FIG. 10).

As described with reference to FIG. 3A through FIG. 4B, the magnetic elements have a coercive force corresponding to the size, shape, magnetic characteristic and the like of the magnetic elements, so that when a magnetic field is applied to these magnetic elements, the detection pulse signal (e.g., detection time, detection output) corresponding to the coercive force possessed by the individual magnetic elements is detected.

Specifically, when the identification information is formed by the combination of two magnetic elements, namely the circular magnetic element 111 and the linear magnetic element 201 as shown on the original document 2 (see FIG. 3A), detection pulse signal A is detected when an alternating magnetic field is applied to the magnetic element 111, and detection pulse signal B is detected when an alternating magnetic field is applied to the magnetic element 201. Therefore, the signal processing part 106 detects the number of magnetic elements according to the combination of the detecting circuits (i, j) 104 which have output the detection signals corresponding to the magnetic pulses emitted by the individual magnetic elements 111, 201 among the plural detecting circuits (i, j) 104, detects the magnetic element 111, 201 according to the detection signals of the detection pulse signals A, B, and outputs the detected results, thereby capable of detecting identification information corresponded with the number and types of the magnetic elements applied to the original document 1.

Figure 11A:
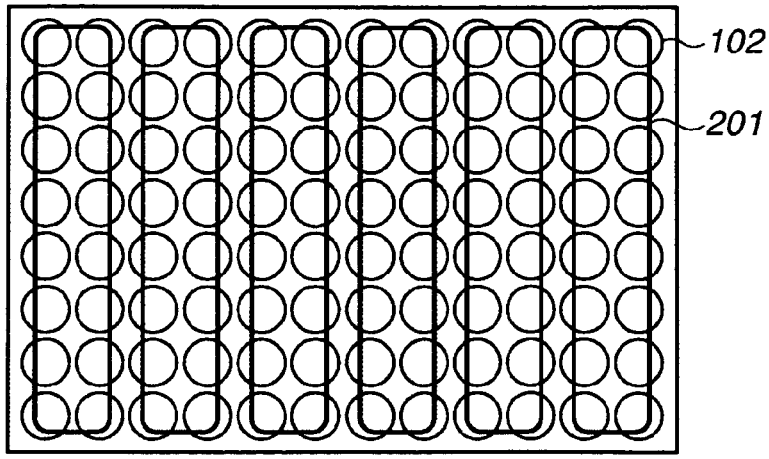
FIGS. 11A through 11C are diagrams showing examples of shapes and arrangements of the magnetizing coils and the detecting coils.
Figure 11B:
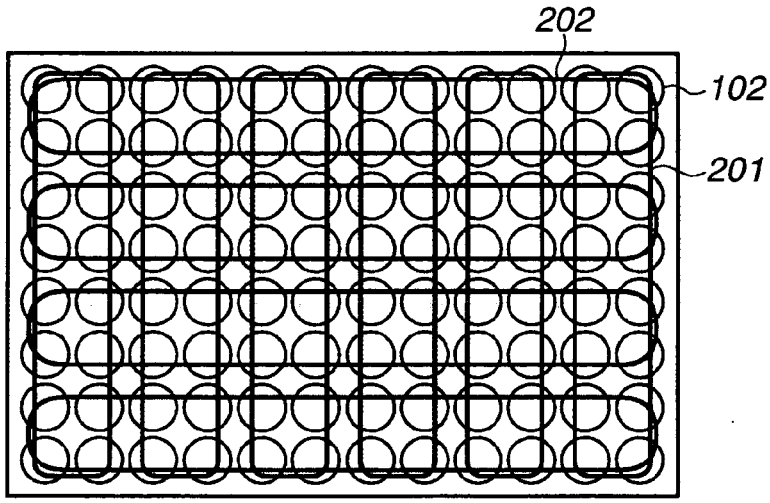
Figure 11C:
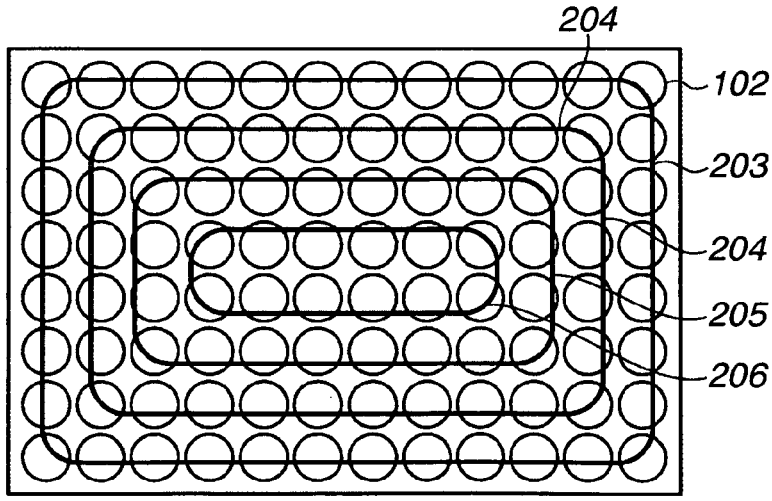

FIGS. 11A through 11C are diagrams showing examples of shapes and arrangements of the magnetizing coils and detecting coils.

As shown in FIG. 11A, plural circular detecting coils 102 which are disposed in a lattice-like pattern and rectangular magnetizing coils 201 having a size of the area where plural rows of detecting coils 102 are arranged in the horizontal direction are arranged in plural, so that a magnetic field can be given to the magnetic element of the original document placed in the detection area of the individual detecting coils 102. Thus, the number of magnetizing coils can be suppressed.

As shown in FIG. 11B, plural circular detecting coils 102 which are disposed in a lattice-like pattern, the plural magnetizing coil 201 shown in FIG. 11A and rectangular magnetizing coils 202 having a size of the area where plural rows of detecting coils 102 are arranged in the vertical direction, are arranged in plural, so that a magnetic field can be applied more securely to the magnetic elements of the original document disposed in the detection area of the individual detecting coils 102.

As shown in FIG. 11C, by disposing plural circular detecting coils 102 arranged in a lattice pattern, a rectangular magnetizing coil 203 having a rectangular size formed by the arrangement of plural detecting coils 102 which are disposed outermost, a rectangular magnetizing coil 204 having a rectangular size formed by the arrangement of plural detecting coils 102 which are disposed inner side, a rectangular magnetizing coil 205 having a rectangular size formed by the arrangement of plural detecting coils 102 which are disposed further inner side, and a rectangular magnetizing coil 206 having a rectangular size formed by the arrangement of plural detecting coils 102 which are disposed innermost, a magnetic field can be applied to the magnetic element of the original document disposed in the detection area of the individual detecting coils 102. Thus, the number of the magnetizing coils can be suppressed.

Figure 12:
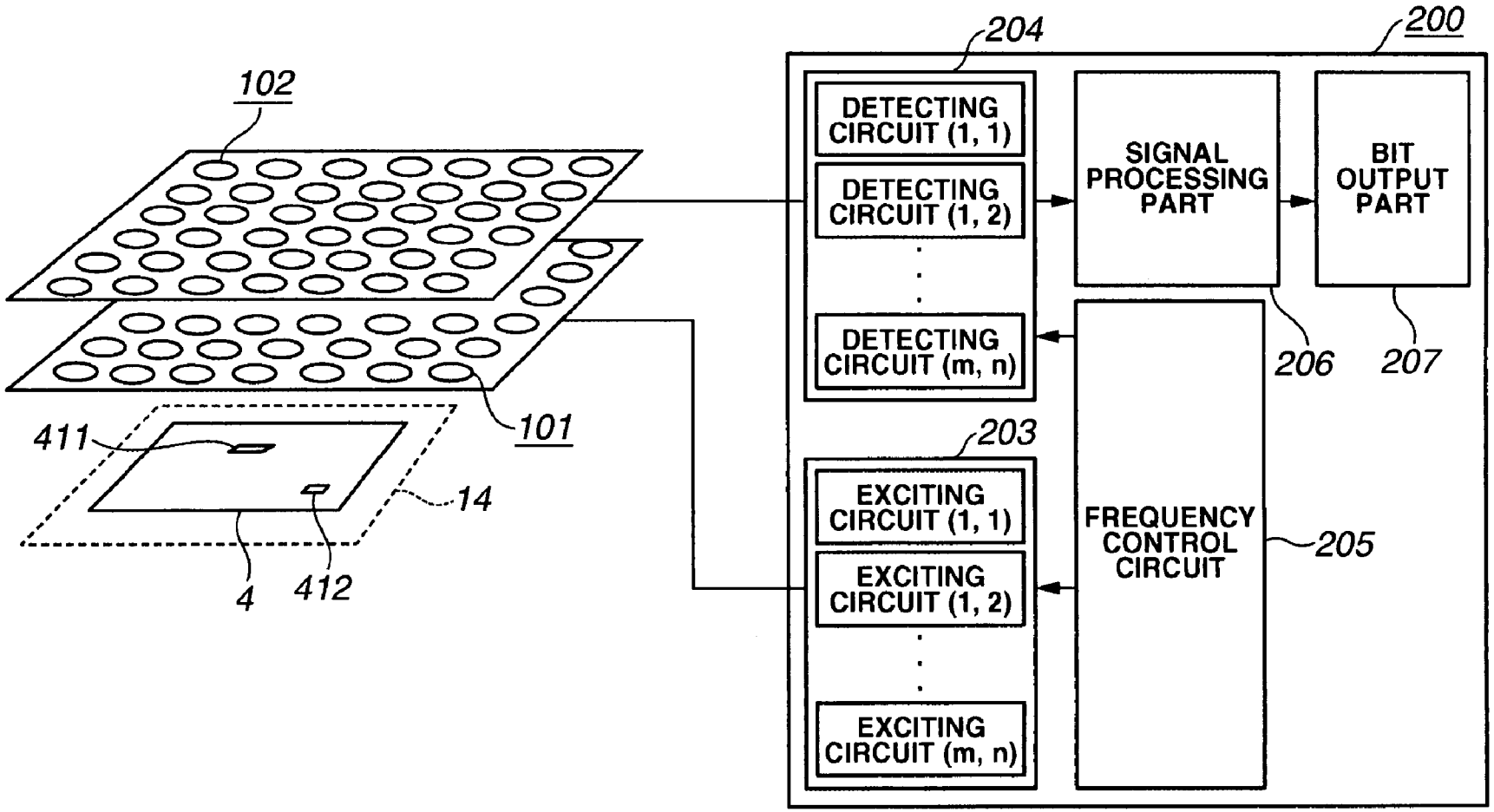
FIG. 12 is a block diagram showing a main part of a information reading device 200 having a different structure from that of the information reading device 100.

FIG. 12 is a block diagram showing a structure of a main part of an information reading device 200 which has a structure different from that of the information reading device 100 shown in FIG. 2 and is configured to read identification information corresponded with the magnetic element applied to a medium.

The information reading device 200 shown in FIG. 12 is an information reading device which is applied when the magnetic element applied to the original document is a magnetic element which has a characteristic of performing magnetostrictive vibration upon receiving a prescribed magnetic field.

As shown in FIG. 12, the information reading device 200 has plural magnetizing coils (i, j) 101 and plural detecting coils (i, j) 102 of which disposed positions are specified by i=1, 2, . . . , m and j=12 . . . n and comprises plural magnetizing circuits (i, j) 203 which control to emit a prescribed alternating magnetic field which varies sequentially from a low frequency to a high frequency via plural magnetizing coils (i, j) 101; plural detecting circuits (i, j) 204 which detect as voltage signals via the detecting coils (i, j) 102 electromagnetic waves which are emitted when magnetic elements 411, 412 (hereinafter referred to as "magnetostrictive vibration element 411" and "magnetostrictive vibration element 412" for convenience of explanation) applied to the original document 4 on the platen glass 14 of the copy machine 10 are magnetized by a prescribed alternating magnetic field emitted from the plural magnetizing coils (i, j) 101 and perform magnetostrictive vibration; a signal processing part 206 which detects the magnetostrictive vibration elements 411, 412 applied to the original document 4 according to the detection signal detected by the detecting circuits (i, j) 204 and detects the number and types of the magnetostrictive vibration elements applied to the original document 4; a bit output part 207 which outputs identification information according to the detected results of the magnetostrictive vibration element output from the signal processing part 206; and a frequency control circuit 205 which controls the frequencies of the plural magnetizing circuits (i, j) 203 and detecting circuits (i, j) 204.

The frequency control circuit 205 controls to perform band limiting or the like of the established frequency of an unshown band pass filter circuit or the like of each of the individual detecting circuits (i, j) 204 in correspondence with the frequency of the alternating magnetic field generated by the magnetizing circuit 203.

The detection of the magnetostrictive vibration elements 411, 412 applied to the original document 4 is made by intermittently emitting an alternating magnetic field having a frequency varying sequentially from a low frequency to a high frequency to give to the magnetostrictive vibration elements 411, 412 so to detect electromagnetic waves emitted by the magnetostrictive vibration of the magnetostrictive vibration elements 411, 412 while an alternating magnetic field is not emitted from the individual magnetizing coils (i, j) 101.

It is also configured that the alternating magnetic field intermittently emitted from the magnetizing coil (i, j) 101 varies sequentially from a prescribed low frequency to a prescribed high frequency, and after reaching the prescribed high frequency, varies again sequentially from the prescribed low frequency to the high frequency, thereby repeating an operation to emit intermittently.

An operation of the information reading device 200 configured as described above to detect the magnetostrictive vibration elements 411, 412 applied to the original document 4 will be described in detail with reference to FIGS. 13A and 13B.

Figure 13A:
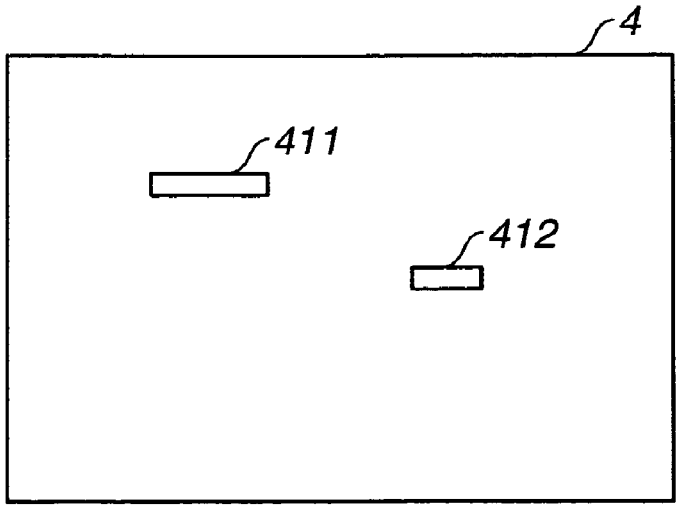
FIGS. 13A and 13B are diagrams showing an example of a method for detecting magnetostrictive vibration elements applied to an original document 4 by the information reading device 200.
Figure 13B:
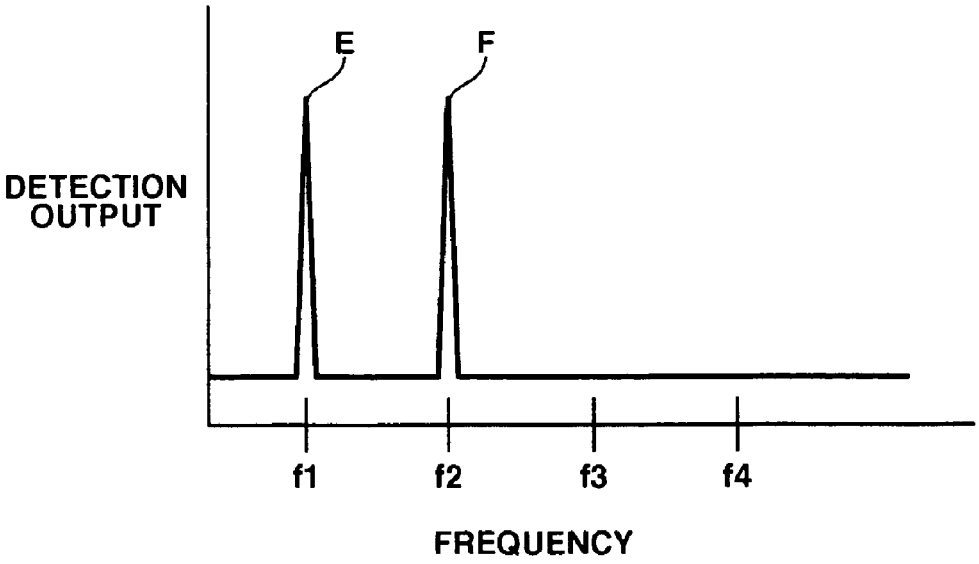

FIG. 13A is a diagram showing an example of the original document 4 to which the magnetostrictive vibration elements 411, 412 to be detected by the information reading device 200 are applied, and FIG. 13B is a diagram showing a detection signal obtained by detecting by the individual detecting circuits (i, j) 204 the electromagnetic waves emitted by the magnetostrictive vibration of the magnetostrictive vibration elements 411, 412.

As shown in FIG. 13A, the magnetostrictive vibration elements 411, 412 forming identification information of the original document 4 are applied to the original document 4.

The individual magnetostrictive vibration elements 411, 412 are thin foil elements of ferrite, amorphous or the like and have a so-called magnetostrictive characteristic that causes a change in dimension upon receiving a prescribed magnetic field from outside.

Where a prescribed alternating magnetic field which varies sequentially from a low frequency to a high frequency or vice versa is given to the individual magnetostrictive vibration elements, the individual magnetostrictive vibration elements magnetostrictively vibrate most largely when they receive an alternating magnetic field having a particular frequency.

The frequency of the alternating magnetic field by which the individual magnetostrictive vibration elements magnetostrictively vibrate most largely is an intrinsic frequency (hereinafter referred to as the "resonance frequency") specified depending on the size, shape and the like of the individual magnetostrictive vibration elements.

Here, description will be made assuming that the magnetostrictive vibration element 411 has a resonance frequency f2, and the magnetostrictive vibration element 412 has a resonance frequency f1.

When the individual magnetostrictive vibration elements perform magnetostrictive vibration, the individual magnetostrictive vibration elements have a change in dimensions, and they emit electromagnetic waves.

Thus, the alternating magnetic fields corresponding to the resonance frequencies inherent to the individual magnetostrictive vibration elements are given to the individual magnetostrictive vibration elements applied to the original document 4 to magnetostrictively vibrate them, and the individual magnetostrictive vibration elements applied to the original document 4 can be detected by detecting the electromagnetic waves emitted by the individual magnetostrictive vibration elements.

To detect the individual magnetostrictive vibration elements applied to the original document 4 by the information reading device 200, a voltage is applied to an unshown voltage control oscillation circuit (e.g., VCO=Voltage Controlled Oscillator, or the like) of the individual magnetizing circuits (i, j) 203 to generate a waveform signal corresponding to the voltage controlled by the voltage control oscillation circuit, and power amplification of the generated waveform signal is performed to control intermittent emission of the alternating magnetic field, which varies from a low frequency to a high frequency, via the individual magnetizing coils (i, j) 101.

Specifically, after an alternating magnetic field having a low frequency is emitted for a prescribed period, the emission is stopped for a prescribed period, an alternating magnetic field having a next higher frequency is emitted for a prescribed period, the emission is stopped for a prescribed period, and the same emission and stop of the emission are repeated sequentially until reaching from a prescribed low frequency to a prescribed high frequency. After the frequency of the alternating magnetic field reaches the prescribed high frequency, the emission and the stop of the emission of the alternating magnetic field which continuously changes linearly from the prescribed low frequency to the prescribed high frequency are repeated again.

When the alternating magnetic field having the frequency f1 emitted from the individual magnetizing coils (i, j) 101 by the above operation is received by the individual magnetostrictive vibration elements applied to the original document 4, the magnetostrictive vibration element 411 magnetostrictively vibrates most largely, and when the alternating magnetic field having the frequency f2 is received by the magnetostrictive vibration element 412 applied to the original document 4, the magnetostrictive vibration element 412 magnetostrictively vibrates most largely.

When the individual magnetostrictive vibration elements perform magnetostrictive vibration, electromagnetic waves are emitted from the individual magnetostrictive vibration elements, the detecting circuit (i, j) 204 connected to the detecting coil (i, j) 102 disposed in the vicinity of the individual magnetostrictive vibration elements detects them as reception signals of voltage signals, which are then filtered by an unshown band pass filter circuit or the like of the detecting circuit (i, j) 204 and amplified by an unshown amplifier circuit or the like, then as shown in FIG. 13B, a pulse signal E corresponding to the resonance frequency f1 of the magnetostrictive vibration element 411 is detected by the detecting circuit (i, j) 204 connected to the detecting coil (i, j) 102 which is disposed in the vicinity of the magnetostrictive vibration element 411, and a pulse signal F corresponding to the resonance frequency f2 of the magnetostrictive vibration element 412 is detected by the detecting circuit (i, j) 204 connected to the detecting coil (i, j) 102 which is disposed in the vicinity of the magnetostrictive vibration element 412.

The signal processing part 206 detects the number and types of the magnetostrictive vibration elements applied to the original document 4 according to the detecting circuit (i, j) 204 which has detected the pulse signal E and the detecting circuit (i, j) 204 which has detected the pulse signal F and outputs the detected results to the bit output part 207.

The bit output part 207 detects identification information corresponded with the number and types of the magnetostrictive vibration elements output from the signal processing part 206 and outputs the detected results as multi-bit information.

Thus, the identification information formed by the magnetic elements applied to the original document is read according to a combination of the detecting circuits which have detected the magnetic elements applied to the original document among the plural detecting circuits and the types of the magnetic elements detected by the pertinent detecting circuit, so that the plural magnetic elements applied to the original document are detected simultaneously and securely regardless of the vertical and horizontal directions in that the original document is placed, and identification information of the original document can be read more accurately.

As described above, a first aspect of the present invention provides an information reading device for reading identification information from a medium to which at least one magnetic element for generating a signal upon receiving a magnetic field is provided, which includes a plurality of detecting parts that detect a signal generated from the magnetic element according to the magnetic field applied to the medium; and an information reading part that reads information formed by the magnetic element based on a combination of detecting parts which have detected the generated signal.

A second aspect of the present invention is the information reading device according to the first aspect of the invention, in which each of the plurality of detecting parts may include a detecting coil for detecting the signal generated from the magnetic element when the magnetic field is applied, and the detecting coils may be disposed in a lattice-like pattern with their centers separated at equal intervals.

A third aspect of the present invention is the information reading device according to the second aspect of the invention, in which detecting areas of the detecting coils may be set in accordance with the intervals of the lattice-like pattern.

A fourth aspect of the present invention is the information reading device according the first aspect of the invention, in which the information reading part may read information that is formed by the magnetic element depending on the presence of detection output of the detecting parts.

A fifth aspect of the present invention is the information reading device according the first aspect of the invention, in which the information reading part may read information that is formed by the magnetic element according to a detection signal pattern of the detecting parts.

A sixth aspect of the present invention is the information reading device according the first aspect of the invention, in which a plurality of magnetic elements may be provided to the medium, and the information reading part may read information which is formed by the magnetic element according to a detection signal pattern detected by the detecting parts in accordance with a combination of the number, length and shape of the magnetic elements.

A seventh aspect of the present invention provides an information reading method, which includes: providing at least one magnetic element to a medium; detecting a signal, which is generated from the magnetic element by a magnetic field applied to the medium by a plurality of detecting parts; and reading information formed by the magnetic element according to a combination of the plurality of detecting parts which have detected the generated signal.

An eighth aspect of the present invention provides a medium to which at least one magnetic element which generates a signal upon receiving a magnetic field is provided, in which the magnetic element is disposed at an interval exceeding a detection area of detecting coils which detects the magnetic element, and information for identifying the medium is formed in correspondence with the number of magnetic elements.

A ninth aspect of the present invention is the medium according to the eighth aspect of the invention, in which a plurality of magnetic elements which have different lengths and shapes may be provided, and information for identifying the medium may be formed according to a combination of the number, lengths and shapes of the magnetic elements.

A tenth aspect of the present invention is the medium according to the eighth aspect of the invention, in which a plurality of magnetic elements which have different magnetic characteristics may be provided; and the information formed by the magnetic element may form information for identifying the medium according to a combination of at least two among number, length and the magnetic characteristics of the magnetic elements.

An eleventh aspect of the present invention is the medium according to the ninth aspect of the invention, in which a plurality of magnetic elements which have different magnetic characteristics may be provided; and the information formed by the magnetic element may form information for identifying the medium according to a combination of at least two among number, length and the magnetic characteristics of the magnetic elements.

A twelfth aspect of the present invention is the medium according to the eighth aspect of the invention in which the signal generated from the magnetic element is a signal generated on the basis of a change in magnetic flux generated when the magnetic element performs magnetization reversal.

A thirteenth aspect of the present invention is the medium according to the eighth aspect of the invention in which the signal generated from the magnetic element may be generated when the magnetic element performs magnetostrictive vibration.

According to the medium to which the magnetic element is applied and the medium information reading method and device of the present invention, there are disposed the plural detecting parts, which apply a magnetic field to the medium and detects a signal generated from the magnetic element applied to the medium by the magnetic field, and the information reading part, which reads information formed by the magnetic element applied to the medium according to a combination of the detecting parts which have detected the signal generated from the magnetic element as the magnetic field is given among the plural detecting parts, so that the plural magnetic elements applied to the medium are detected simultaneously and securely regardless of the vertical and horizontal directions of the medium placed, and identification information of the medium can be read more accurately.

The arrangement pattern of the magnetic elements applied to the medium can be detected, so that identification information of the medium to which a larger volume of information is applied can be read, thereby producing an effect that the medium with high security assured can be provided.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-84177 filed on Mar. 23, 2005 including specification, claims, drawings and abstract is incorporated herein by reference in its entirety.

What is claimed is:

1. An information reading device for reading identification information from a medium to which at least one magnetic element for generating a signal upon receiving a magnetic field is provided, comprising:

a plurality of detecting parts that detect presence of the at least one magnetic element by detecting the signal generated from the at least one magnetic element according to the magnetic field applied to the medium; and an information reading part that reads information formed by the at least one magnetic element based on a combination of the presence of the at least one magnetic element detected by each of the plurality of detecting parts, wherein the magnetic field is provided by at least one magnetizing coil, the at least one magnetizing coil enclosing an area that includes the plurality of detecting parts, and the at least one magnetic element comprises a plurality of magnetic elements are provided to the medium, and the information reading part reads information which is formed by the at least one magnetic element according to a detection signal pattern detected by the detecting parts in accordance with a combination of the number, length and shape of the plurality of magnetic elements;

each of the plurality of detecting parts includes a detecting coil for detecting the signal generated from the at least one magnetic element when the magnetic field is applied, and includes a detecting circuit connected in association with each detecting coil, for detecting the signal detected by each detecting coil and for outputting a detection signal;

the detecting coils are disposed in a lattice-like pattern with their centers separated at equal intervals and each detecting area of the detecting coils in which the signal generated from the at least one magnetic element is detectable is the same in size with each other; and when an output pattern of detection signals from detecting circuits associated with detecting coils adjacent to each other among the detecting coils are included in the detection signal pattern, the information reading part reads information formed by the at least one magnetic element by detecting a fact that signals detected by the detecting coils adjacent to each other are generated from an identical magnetic element.

2. An information reading method, comprising:

providing at least one magnetic element to a medium;

detecting presence of the at least one magnetic element by detecting a signal, which is generated from the at least one magnetic element by a magnetic field applied to the medium by a plurality of detecting parts; and reading, by a information reading part, information formed by the at least one magnetic element according to a combination of the presence of the at least one magnetic element detected by each of the plurality of detecting parts, wherein the magnetic field is applied to the medium by at least one magnetizing coil, the at least one magnetizing coil enclosing an area that includes the plurality of detecting parts, and the at least one magnetic element comprises a plurality of magnetic elements are provided to the medium, and the information reading part reads information which is formed by the at least one magnetic element according to a detection signal pattern detected by the detecting parts in accordance with a combination of the number, length and shape of the plurality of magnetic elements;

each of the plurality of detecting parts includes a detecting coil for detecting the signal generated from the at least one magnetic element when the magnetic field is applied, and includes a detecting circuit connected in association with each detecting coil, for detecting the signal detected by each detecting coil and for outputting a detection signal;

the detecting coils are disposed in a lattice-like pattern with their centers separated at equal intervals and each detecting area of the detecting coils in which the signal generated from the at least one magnetic element is detectable is the same in size with each other; and when an output pattern of detection signals from detecting circuits associated with detecting coils adjacent to each other among the detecting coils are included in the detection signal pattern, the information reading part reads information formed by the at least one magnetic element by detecting a fact that signals detected by the detecting coils adjacent to each other are generated from an identical magnetic element.

* * * * *